US005903241A

United States Patent [19]

Bhattacharyya

[11] Patent Number: 5,903,241

[45] Date of Patent: May 11, 1999

[54] WAVEGUIDE HORN WITH RESTRICTED-LENGTH SEPTUMS

[76] Inventor: Arun K. Bhattacharyya, 810 Main St., Apt. 9, El Segundo, Calif. 90245

[21] Appl. No.: 08/870,753

[22] Filed: Jun. 9, 1997

Related U.S. Application Data

[63] Continuation of application No. 08/520,665, Aug. 28, 1995, abandoned.

[51] Int. Cl.[6] ..... H01Q 13/02

[52] U.S. Cl. ..... 343/786

[58] Field of Search ..... 343/786; H01Q 13/00

[56] References Cited

U.S. PATENT DOCUMENTS

| | | | |
|---|---|---|---|
| 2,650,985 | 9/1953 | Rust et al. | 343/786 |
| 2,743,440 | 4/1956 | Riblet | 343/786 |
| 3,100,894 | 8/1963 | Giller et al. | 343/786 |
| 3,171,129 | 2/1965 | Nowakowski et al. | 343/786 |

OTHER PUBLICATIONS

Peace, George M., et al., "Amplitude Compensated Horn Antenna", *The Microwave Journal,* Feb., 1964, pp. 66–68.

*Primary Examiner*—Michael C. Wimer

*Attorney, Agent, or Firm*—Terje Gudmestad; Georgann Grunebach; Michael W. Sales

[57] ABSTRACT

A waveguide horn has septums to decrease the side lobes in its E-plane radiation pattern and the input ends of the septums are spaced from the horn's rectangular input port to improve the return loss of the horn. The input ends are preferably spaced from the input port >3a in which a is the dimension of the broad side of the input port.

14 Claims, 4 Drawing Sheets

WAVEGUIDE HORN WITH RESTRICTED-LENGTH SEPTUMS

This is a continuation of application Ser. No. 08/520,665 filed Aug. 28, 1995, now abandoned.

BACKGROUND OF THE INVENTION

1. Field of the Invention

The present invention relates generally to microwave antennas and more particularly to feed horns.

2. Description of the Related Art

To reduce the side lobes in an antenna beam from a reflector antenna, the amplitude of the reflector's feed signal should preferably be on the order of 10 db down in the direction of the reflector edges. On the other hand, the radiation pattern at a wavelength $\lambda$ from a rectangular waveguide with dimensions $a=0.71\lambda$ and $b=0.32\lambda$ typically meets this criterion (10 db down) for angles of 180° and 120° in the waveguide's electric plane and magnetic plane respectively. For enhanced performance with this waveguide as a feed, a reflector would have to be shaped to intercept these angles. A reflector with a significantly different shape would have reduced performance in one or more parameters, e.g., side lobe levels or gain. Alternatively, enlarging the waveguide to narrow its radiation pattern would invite excitation of undesired modes in the waveguide.

For these reasons, an open-ended waveguide can be used as the feed aperture for a reflector antenna only in restricted situations. Typically, reflector dimensions are determined by the requirements of an application and the feed aperture dimensions must then be selected accordingly. Flaring a terminal end of a waveguide to form a larger aperture, i.e., forming a pyramidal waveguide horn, is a conventional solution in constructing a feed for a reflector antenna.

The structure of a pyramidal waveguide horn is advantageous in that it allows the horn's input port dimensions to be selected for enhancement of single mode propagation in the waveguide which connects to the input port, while other dimensions of the horn, e.g., horn length and flare angle, are selected for efficient illumination of a specific reflector antenna. The input waveguide can then essentially act as a filter to suppress propagation of undesired modes so that the field at the horn's input port is relatively independent of the length of the waveguide.

Without the use of further structures, the side lobe suppression of a well-designed, pyramidal waveguide horn is limited to ~12 db in its E-plane radiation pattern. In contrast, H-plane radiation patterns of these horns typically have a slightly wider beam width than the E-plane pattern but a much improved side lobe suppression. It is difficult to efficiently illuminate a reflector antenna with a waveguide horn that has inferior side lobe suppression. If the radiation pattern of the horn is narrowed to bring the side lobes within the reflector illumination, an undesirable illumination distribution is obtained. If the radiation pattern of the horn is widened to exclude the side lobes from the reflector illumination, efficiency is lowered because of lost "spill over" power.

Circular, corrugated, waveguide horns have an E-plane radiation pattern which is superior to that of pyramidal waveguide horns. However, because of their weight (usually 6–8 times that of an equivalent pyramidal waveguide horn) and high manufacturing cost, their use is limited to special applications in which weight and cost are not critical considerations.

Septums have been introduced into pyramidal waveguide horns for the purpose of obtaining lower side lobes in the E-plane radiation pattern. The septums are typically arranged orthogonally with the radiation's E field so that the uniform amplitude distribution of the E field across the output aperture is converted into a tapered amplitude distribution. This tapering has been found to produce an E-field radiation pattern whose side lobe performance approaches that of the H-field radiation pattern.

Typically, the introduction of septums into a waveguide horn does not significantly degrade the return loss at the input port. It is probable that this follows from, the fact that, even without septums, waveguide horns generally provide an inferior impedance match to a feed waveguide.

In spite of this, attempts have been made to improve the impedance match of horns with septums because antenna losses directly degrade the efficiency of the system containing the antenna and decreased system efficiency generally raises costs and lowers performance. As an example of these attempts, the thickness of the septums has been reduced as far as structurally possible to improve the input port return loss.

SUMMARY OF THE INVENTION

The present invention is directed to waveguide horns which can radiate low side lobes from an output aperture and also have low reflection loss at a rectangular input port.

This goal is realized by restricting the length of septums in the waveguide horn so that the input ends of septums are separated from an input port by a space which is >3a and, preferably >4a, in which a is the dimension of the broad sides of the input port.

In a first waveguide horn, the septum input ends are spaced from the input port $>2\lambda_{op}$ in which $\lambda_{op}$ is the desired operating wavelength or is the longest operating wavelength in a range of operating wavelengths. A computer simulation of this horn had improved return loss (~24–35 db) while still having improved side lobes (~18 db down). The spacing of $>2\lambda_{op}$ is equivalent to a spacing of >3a.

In a second waveguide horn, the septum input ends are spaced from the input port $>2.9\lambda_{op}$. A computer simulation of this horn had the improved return loss and side lobes of the first waveguide horn and also had improved side lobe rejection past 40° from boresight. The spacing of $>2.9\lambda_{op}$ is equivalent to a spacing of >4.3a.

Thus, waveguide horns are realized which maintain good side lobe rejection for efficient reflector antenna illumination while having increased return loss for enhancing system efficiency.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
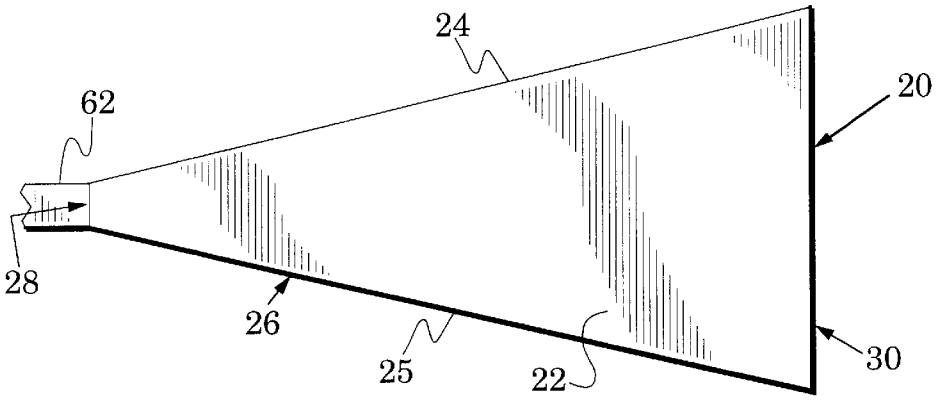
FIG. 1 is a side elevation view of a waveguide horn with restricted-length septums.

A pyramidal waveguide horn with restricted-length septums is illustrated in FIGS. 1–4. The horn 20 has a first pair of spaced walls 22 and 23 and a second pair of spaced walls 24 and 25. The walls are joined to form a pyramidal waveguide 26 with one end of the pyramidal waveguide arranged to form a rectangular input port 28 and the other end of the pyramidal waveguide arranged to form an output aperture 30. The walls 22–25 are flared outward from the input port 28 so that the area of the output aperture is larger than the area of the input port. The walls 22–25 are arranged symmetrically about a horn axis 32 (shown in FIG. 4) and are dimensioned to separate the input port 28 and the output aperture 30 by a horn length 33.

The input port 28 has a pair of narrow, spaced sides 34 and 35 and a pair of broad, spaced sides 36 and 37 with the broad sides longer than the narrow sides. A pair of septums 40 and 42 are arranged to extend between the spaced walls 22 and 23 and to be substantially parallel with the broad sides 36 and 37 of the input port 28.

The septums 40 and 42 have respective input ends 44 and 45 and respective output ends 46 and 47. The output ends 46 and 47 are coplanar with the output aperture and are spaced to divide the output aperture 30 into a central aperture 50 and a pair of edge apertures 52. For this purpose the output ends 46 and 47 are positioned apart by a space 55 and they are respectively positioned from the top and bottom of the output aperture 30 by a space 56. The input ends 44 and 45 of the septums are positioned so that they are each separated from their adjacent wall by a space 58 and are separated from the input port 28 by a space 60.

For the purpose of feeding a microwave signal to the input port 28 (or receiving a microwave signal from the input port), a rectangular waveguide 62 is joined to the input port 28.

Figure 2:
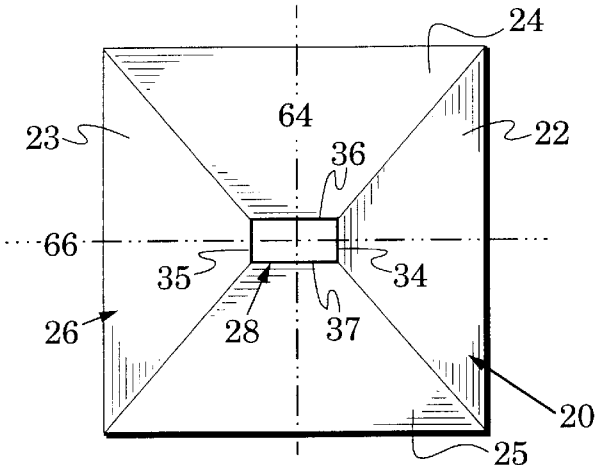
FIG. 2 is a rear elevation view of the waveguide horn of FIG. 1.
Figure 3:
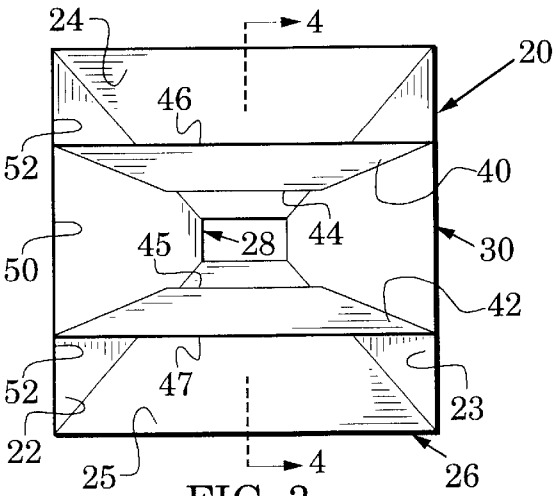
FIG. 3 is a front elevation view of the waveguide horn of FIG. 1.
Figure 4:
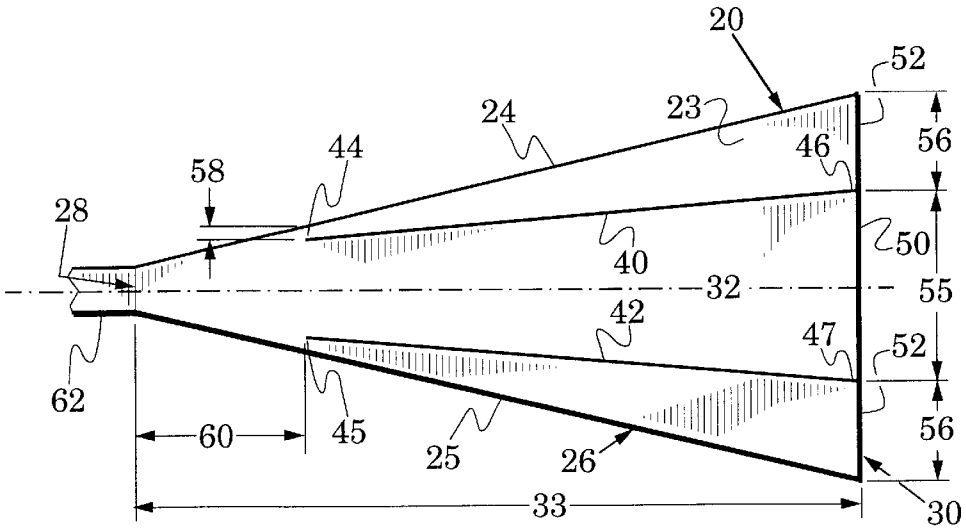
FIG. 4 is a view along the plane 4—4 of FIG. 3.

The input port 28 (and the rectangular waveguide 62) is configured to support the $TE_{10}$ electromagnetic mode with the electric field vector arranged parallel with the port sides 34 and 35 and the magnetic field lines arranged parallel with the port sides 36 and 37. In accordance with convention, a vertical axis 64 and a horizontal axis 66 through the input port 28 are referred to as the E plane and the H plane respectively of the waveguide horn 20 (the axes 64 and 66 are shown in FIG. 2).

In operation, a microwave signal is fed through the waveguide 62 and into the input port 28. The flaring walls 22–25 of the horn 20 provide an impedance match between the input port 28 and free space as the microwave signal is radiated from the output aperture as an electromagnetic antenna beam with a free-space wavelength λ. The dimensions of the input waveguide 62 are typically set by the frequency band of interest and the dimensions of the input port 28 are determined by those of the waveguide 62. The flare angle of the walls 22–25 and the horn length 33 (and, thus, the size of the output aperture 30) are selected to form a desired antenna beam shape (e.g, beam width, side lobe level and so on). In a general relationship, the greater the dimension of the output aperture 30 along the E plane 64 and the H plane 66, the narrower the antenna beam along these same axes in free space. The desired beam shape is generally dictated by the need to efficiently illuminate a reflector antenna.

Without the septums 40 and 42, the electric field vectors extend between the walls 24 and 25 at the output aperture 30. These vectors establish a uniform amplitude distribution across the output aperture 30. It is known that the side lobes in the E plane 64 of the radiated antenna beam can be reduced if the amplitude distribution across the output aperture 30 follows a tapered function in which the amplitude is highest in the center of the output aperture 30 and least adjacent the walls 24 and 25.

A tapered function can be approximated by dividing the output aperture 30 into subapertures. In the waveguide horn 20, the output ends 46 and 47 of septums 40 and 42 divide the output aperture 30 into a pair of edge apertures 52 and a central aperture 50. The central aperture is configured to have an area that is some multiple, e.g., 2, of the area of the edge apertures 52 so as to approximate a tapered function. The space 58 between the septum input ends 44 and 45 and their respective, proximate wall (24 and 25) is selected in conjunction with the other dimensions of the horn 20 to enhance the tapered function and, thereby, the reduction of side lobes in the E plane of the radiated antenna beam.

Although the septums 40 and 42 are effective in reducing these antenna beam side lobe levels, they are typically accompanied by relatively poor return loss at the input port 28 of the horn. In accordance with the present invention, the septum input ends 44 and 45 are separated by the space 60 from the input port 28 to increase the return loss at the input port 28 and thus improve the efficiency of the waveguide horn 20. In particular, the space 60 is selected to be $>2\lambda_{op}$ in which $\lambda_{op}$ is the desired operating wavelength or is the longest operating wavelength in a range of operating wavelengths.

Figure 6:
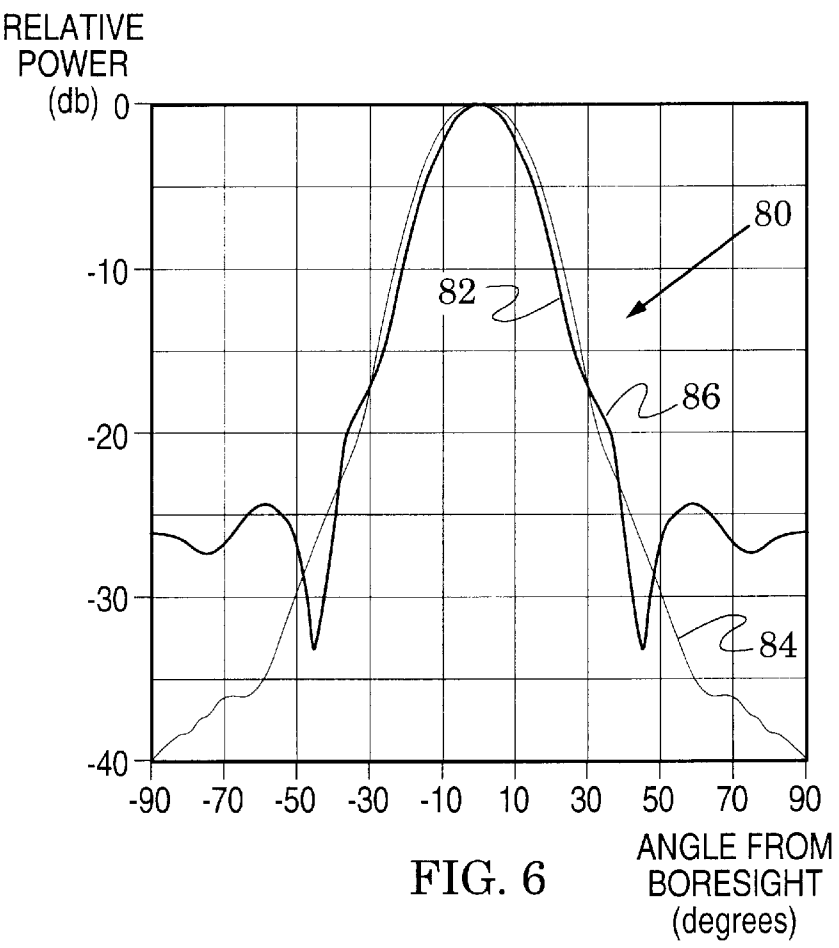
FIG. 6 is a graph of radiation patterns in the E and H planes of the waveguide horn associated with FIG. 5.
Figure 5:
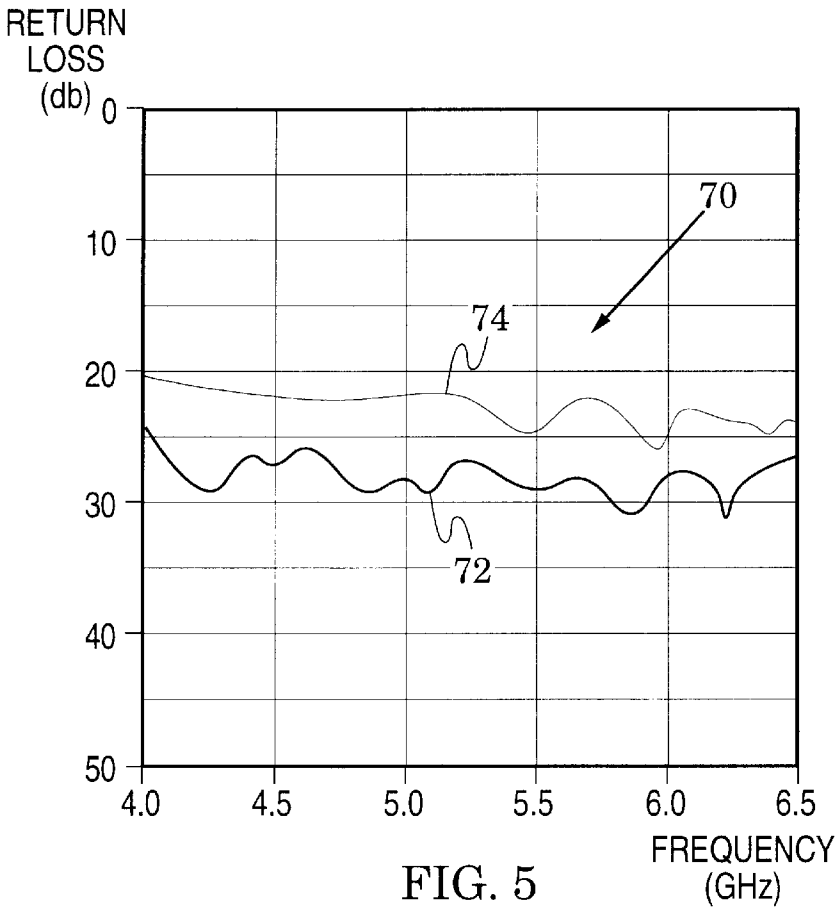
FIG. 5 is a graph of computed return loss for a waveguide horn which is similar to the horn of FIGS. 1–4.

The improvement in waveguide horn performance, which is brought about by restricting the septum lengths, is illustrated in FIGS. 5 and 6 which are computer simulation graphs of return loss 70 and radiation patterns 80. These graphs apply to a first pyramidal horn in accordance with FIGS. 1–4, in which the space 60 was selected to be 16.51 centimeters. The performance was calculated for frequencies from 4 to 6.5 GHz which is for wavelengths between 4.6 and 7.5 centimeters. Thus, the space 60 is $>2\lambda_{op}$ in this horn. In the first pyramidal horn, the narrow sides 34 and 35 are 2.56 centimeters and the broad sides 36 and 37 are 5.1 centimeters. The horn length 33 is 43.2 centimeters, the space 56 is 5.7 centimeters, the space 55 is 11.4 centimeters, the space 58 is 1.06 centimeters and the output aperture 30 is square in shape.

Return loss is defined as $10\log(P_i/P_r)$ in which $P_i$ is the incident power on a discontinuity and $P_r$ is the reflected power from that discontinuity. If the discontinuity is well matched, return loss will be large, e.g., a return loss of 30 db indicates a better match (less reflected power) than does a return loss of 20 db. The return loss graph 70 illustrates the calculated return loss 72 of the first pyramidal horn described above. In contrast, the calculated return loss for a conventional pyramidal horn with septums in which the space 60=0, is shown as the curve 74. The return loss is clearly improved over the conventional horn.

The graph 80 of radiation patterns illustrates the E-plane radiation pattern 82 and the H-plane radiation pattern 84 for the first pyramidal horn described above. The H-plane pattern approximates the expected cosine taper while the E-plane pattern has side lobes 86 which are approximately −18 db (below the main lobe) which is 6 db below the side lobes of typical pyramidal horns without septums. The lower side lobes will reduce "spill over" loss (by ~0.5 db) in a reflector antenna that is illuminated by this horn and this improved illumination will, in turn, improve the overall gain of the reflector (also by ~0.5 db).

Figure 7:
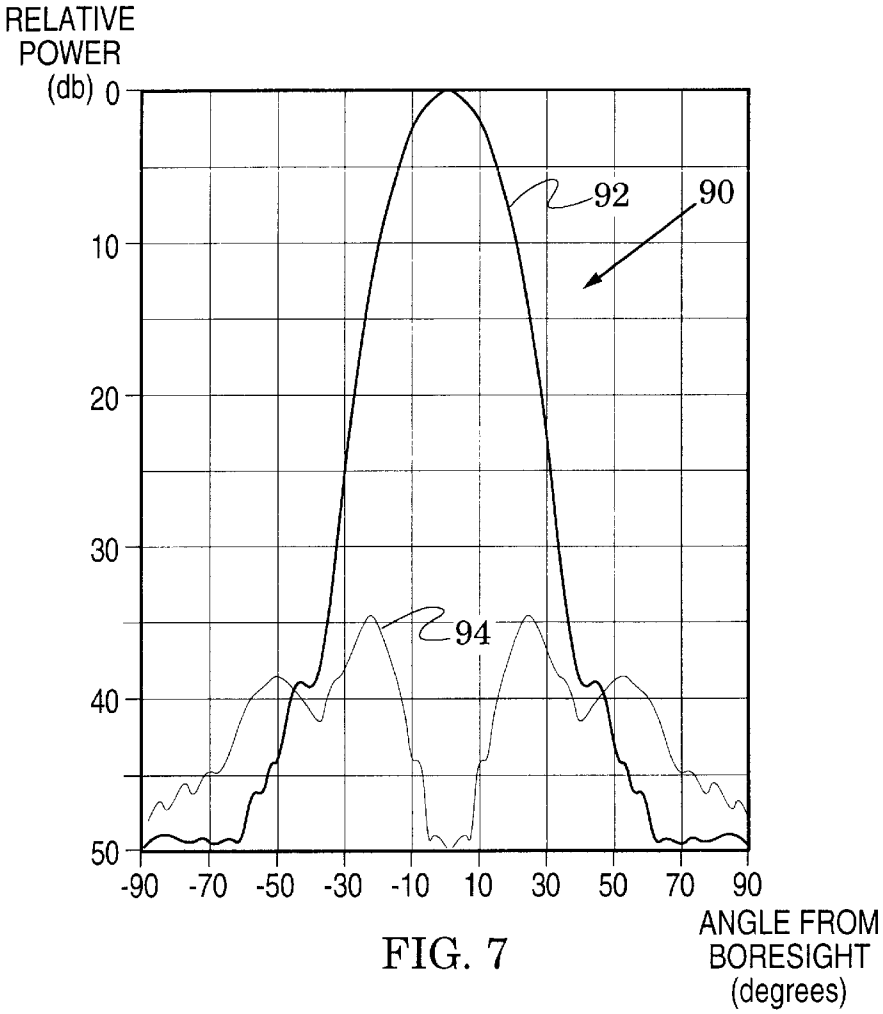
FIG. 7 is a graph of main polarization and cross polarization patterns of the waveguide horn associated with FIG. 5.

FIG. 7 is a graph 90 of calculated main polarization 92 (often referred to as COPOL) and cross polarization 94 (often referred to as CROSSPOL) for the first pyramidal horn described above. The cross polarization 94 is >32 db below the main polarization which indicates a desirably low level of cross polarization.

Figure 9:
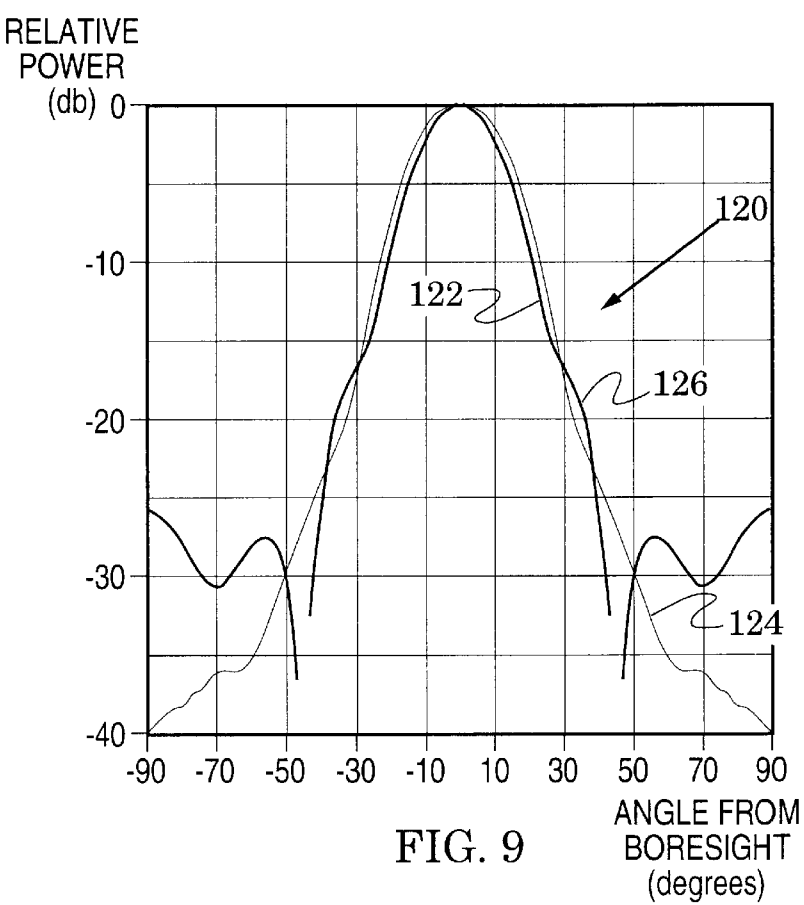
FIG. 9 is a graph of radiation patterns in the E and H planes of the waveguide horn associated with FIG. 8.
Figure 8:
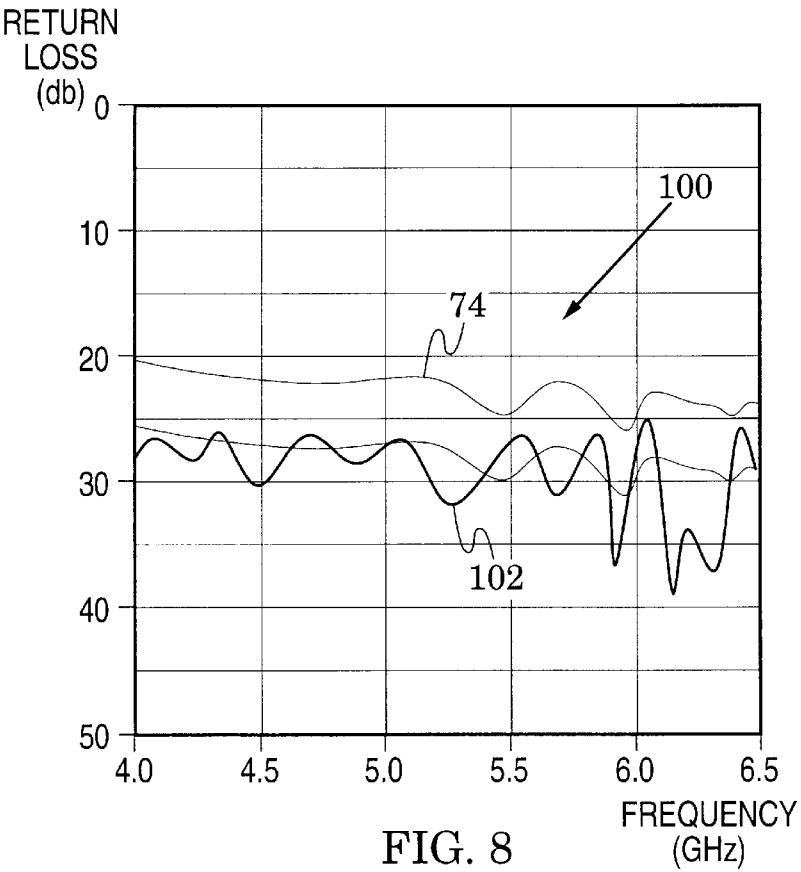
FIG. 8 is a graph of computed return loss for another waveguide horn which is similar to the horn of FIGS. 1–4.

The improvement in waveguide horn performance due to restricted-length septums, is illustrated again in FIGS. 8 and 9 which are computer simulation graphs of return loss 100 and radiation patterns 120 for a second pyramidal horn in which the space 60 was selected to be 21.6 centimeters. The performance was again calculated for wavelengths between 4.6 and 7.5 centimeters. Thus, the space 60 is $>2.9\lambda_{op}$ for this horn. At the input port 28, the narrow sides 34 and 35 are 2.56 centimeters and the broad sides 36 and 37 are 5.1 centimeters. The horn length 33 is 43.2 centimeters, the space 56 is 5.7 centimeters, the space 55 is 11.4 centimeters, the space 58 is 1.26 centimeters and the output aperture 30 is square in shape.

The return loss graph 100 illustrates the calculated return loss 102 of the second pyramidal horn described above. The return loss is again compared with the calculated return loss 74 for a conventional pyramidal horn with septums, in which the space 60=0. The return loss is again clearly improved by restricting the septum length.

The graph 120 of radiation patterns illustrates the E-plane radiation pattern 122 and the H-plane radiation pattern 124 for the second pyramidal horn described above. The E-plane pattern again has side lobes 126 which are approximately 18 db below the main lobe. Although their return loss is substantially equal and their first side lobe reduction is substantially the same, the second pyramidal horn has even lower side lobes than the first pyramidal horn in the region past 40° from boresight.

The dimension of the space 60 can be related to the dimensions of the input port 28. As mentioned above, the waveguide 62 and the input port 28 act as a filter which allows only a single mode to be propagated to the output aperture 30. This is a result of the well-known fact that a rectangular waveguide suppresses the propagation of the $TE_{10}$ mode for signals whose wavelength is greater than the waveguide's cutoff wavelength $\lambda_C$=2a in which a is the length of the broad side of the waveguide, i.e., the sides 36 and 37 in FIG. 2.

In waveguide transmission, the cutoff wavelength is preferably set to be larger than the largest operating wavelength $\lambda_{op}$ by a margin, e.g., 50%, which is sufficient to minimize the losses due to wall currents in the waveguide at the operating wavelength. A margin of 50% is realized by selecting the broad sides 36 and 37 to be $\sim 0.67\lambda_{op}$. Therefore, selecting the space 60 to be $>2\lambda_{op}$ is equivalent to setting the space 60 >3a. Selecting the space 60 to be $>2.9\lambda_{op}$ is equivalent to setting the space 60 >4.3a.

The configuration of the waveguide horn 20 without the septums 40 and 42, is conventionally referred to as a pyramidal horn because the output aperture 30 has larger dimensions than does the input port 28 in both the E plane 64 and the H plane 66. In contrast, a horn whose output aperture has a larger dimension than its input port in the E plane but the same dimension in the H plane is conventionally referred to as an E-plane sectoral horn. A horn whose output aperture has a larger dimension than its input port in the H plane but the same dimension in the E plane is conventionally referred to as an H-plane sectoral horn.

Figure 10:
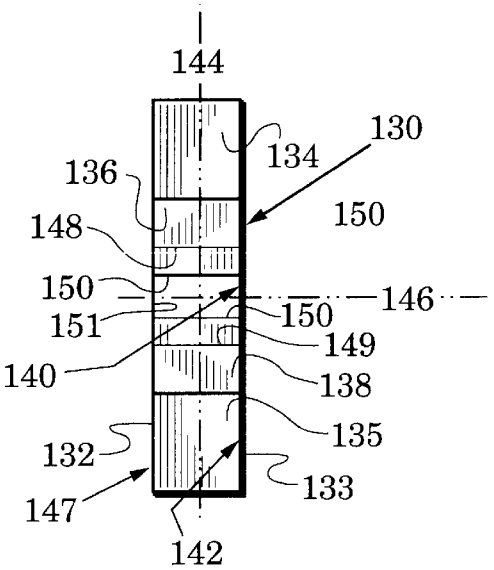
FIG. 10 is a view similar to FIG. 3, which illustrates an E-plane, sectoral horn with restricted-length septums.

The present invention has been illustrated with reference to a pyramidal horn. However, the teachings of the invention can be applied to other horns. In particular, E-plane sectoral horns are a special case of pyramidal horns in which the horn does not flare outward (from the input port to the aperture) in the H plane of the horn. FIG. 10 illustrates an E-plane sectoral horn 130 with septums that has a pair of spaced walls 132 and 133 and a pair of spaced walls 134 and 135. Septums 136 and 138 connect the spaced walls 132 and 133. The horn 130 has an input port 140 and an output aperture 142 and is configured about an E plane 144 and an H plane 146. In contrast with the horn 20 of FIGS. 1–4, the walls 132 and 133 are parallel with the E plane 144. Similar to the horn 20, the walls 134 and 135 flare outward to the output aperture. The walls 132–135 form an E-plane sectoral horn 147.

Also similar with the horn 20, the septums 136 and 138 have input ends 148 and 149 which are spaced from the input port 140 to increase the return loss of the antenna 130. The spacing is preferably >3a in which a is the length of the broad sides 150 of the input port 140. The input port 140 also has narrow sides 151.

The teachings of the invention may be extended to horns with other than two septums. For example, four septums can define a central aperture and two sets of subapertures which facilitates the development of a tapered amplitude in the output aperture. Restricting the length of these septums will also increase the return loss of the horn.

Waveguide horns with restricted-length septums achieve good side lobe performance in their E plane radiation. Although it may be unexpected (because waveguide horns without septums also generally have inferior return loss performance), they also realize increased return loss relative to waveguide horns with septums that extend to the input port. This improved performance is realized by selecting the space between the septum input ends and the input port to be >3a and preferably, >4a, in which a is the dimension of the broad side of the input port. Besides having improved performance, the restricted length of the septums permits the weight of the waveguide horn to be reduced. Although this weight reduction appears small, it is advantageous in applications in which weight is critical, e.g., satellites.

Figure 11:
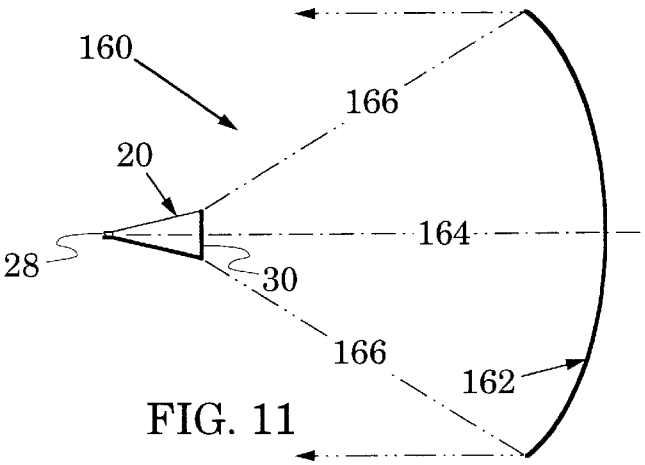
FIG. 11 is a side elevation view of an antenna system.

Waveguide horns in accordance with the present invention are particularly suited for illumination of reflector antennas. For example, FIG. 11 illustrates an antenna system 160 which includes the horn 20 of FIGS. 1–4 and a microwave reflector 162. The reflector 162 can be any of the conventional reflector shapes, e.g., paraboloid, parabolic cylinder and shaped. The output port 30 is directed at and spaced from the reflector 162 (typically along a common axis 164) and is configured to illuminate the reflector with microwave radiation (indicated by broken lines 166) when a microwave signal is received at the input port 28.

As is well known, antennas have the property of reciprocity, i.e., the characteristics of a given antenna are the same whether it is transmitting or receiving. The use of terms such as illumination and radiation in the description and claims are for convenience and clarity of illustration and are not intended to limit structures taught by the invention. A waveguide horn with increased return loss will have its efficiency improved in reception as well as in transmission.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A sectoral waveguide horn comprising:

an E-plane four-sided structure having a rectangular input port with an input area and an output aperture with an output area which is greater than said input area, said input port having a pair of broad sides with a first length and a pair of narrow sides with a second length that is less than said first length; and N septums extending across said structure and arranged substantially parallel with said broad sides, said septums each having an input end directed towards said input port and an output end directed towards said output aperture with said output ends positioned to divide said output aperture into a plurality of subapertures;

wherein said input end of each and every of said septums is positioned with a predetermined spacing from said input port corresponding to a multiple of said first length to improve return loss of said input port, the predetermined spacing being greater than 3 times said first length.

2. The waveguide horn of claim 1, wherein said spacing is greater than 4 times said first length.

3. The waveguide horn of claim 1, wherein N=2.

4. The waveguide horn of claim 1, wherein N=4.

5. A waveguide horn for use with a predetermined range of operating wavelengths delineated by a shortest operating wavelength and a longest operating wavelength, the horn comprising:

a four-sided structure having a first end defining an input port with an associated input port area and a second end defining an output aperture with an associated output area, the output area being greater than the input area; and at least two septums each being substantially parallel to and extending across an opposite side of the four-sided structure, each septum having an output end positioned to be coplanar with the output aperture to divide the output aperture into a plurality of subapertures and an input end positioned a predetermined distance from the input port, the predetermined distance being based on the longest operating wavelength to improve impedance matching at discontinuities introduced by the input ends of the septums so as to reduce power reflected from the input ends of the septums to improve return loss and increased efficiency of the horn, wherein the predetermined distance is greater than twice the longest operating wavelength.

6. The waveguide horn of claim 5 wherein the input port of the four-sided structure defines a rectangle and the output aperture defines a square.

7. The waveguide horn of claim 5 wherein the input port defines a rectangle having two opposing narrow sides and two opposing broad sides having an associated length and wherein the predetermined distance is based on the length of the broad sides.

8. The waveguide horn of claim 7 wherein the predetermined distance is at least three times the length of the broad sides.

9. The waveguide horn of claim 7 wherein the predetermined distance is at least four times the length of the broad sides.

10. The waveguide horn of claim 5 wherein the at least two septums comprise four septums.

11. A waveguide horn comprising:

a four-sided pyramidal structure having a first end defining a rectangular input port with a first pair of opposing sides having a first length longer than a second pair of opposing sides, the input port also having an associated input port area, the structure having a second end defining an output aperture with an associated output area, the output area being greater than the input area; and at least two septums each being substantially parallel to and extending across an opposite side of the four-sided structure, each septum having an output end positioned to be coplanar with the output aperture to divide the output aperture into a plurality of subapertures and an input end positioned a predetermined distance from the input port, the predetermined distance being based on the first length of the rectangular input port to improve impedance matching at discontinuities introduced by the input ends of the septums so as to reduce power reflected from the input ends of the septums to improve return loss and increase efficiency of the horn, wherein the predetermined distance is at least three times the first length.

12. The waveguide horn of claim 11 wherein the predetermined distance is at least four times the first length.

13. The waveguide horn of claim 11 wherein the at least two septums are positioned substantially perpendicular to an E-plane.

14. The waveguide horn of claim 11 wherein the at least two septums comprise four septums.

* * * * *